US010064531B2

(12) United States Patent
Ruiz-Porath et al.

(10) Patent No.: US 10,064,531 B2
(45) Date of Patent: Sep. 4, 2018

(54) FLOOR CLEANING MACHINE

(71) Applicant: Hako GmbH, Bad Oldesloe (DE)

(72) Inventors: Ricardo Ruiz-Porath, Bad Oldesloe (DE); Carsten Protz, Altenkrempe (DE); Anatoliy Schmidt, Bad Oldesloe (DE)

(73) Assignee: Hako GmbH, Bad Oldesloe (DE)

( * ) Notice: Subject to any disclaimer, the term of this patent is extended or adjusted under 35 U.S.C. 154(b) by 532 days.

(21) Appl. No.: 14/727,890

(22) Filed: Jun. 2, 2015

(65) Prior Publication Data

US 2015/0359397 A1 Dec. 17, 2015

(30) Foreign Application Priority Data

Jun. 11, 2014 (EP) ..... 14171957

(51) Int. Cl.
*A47L 11/30* (2006.01)
*A47L 11/40* (2006.01)

(52) U.S. Cl.
CPC ..... *A47L 11/305* (2013.01); *A47L 11/4044* (2013.01); *A47L 11/4055* (2013.01); *A47L 11/4061* (2013.01); *A47L 11/4069* (2013.01)

(58) Field of Classification Search
CPC ..... A47L 11/4052; A47L 11/4055; A47L 11/305; A47L 11/4044; A47L 11/4061; A47L 11/4069
USPC ..... 15/354, 355, 373, 365, 333
See application file for complete search history.

(56) References Cited

U.S. PATENT DOCUMENTS 1,969,674 A * 8/1934 Anderson-Smedberg ..... A47L 11/305 15/320
2,248,699 A * 7/1941 Finnell ..... A47L 11/283 15/180
2,558,864 A * 7/1951 Funnekotter ..... A47L 11/16 15/333
2,969,557 A * 1/1961 Petersen ..... A47L 11/305 15/320
3,065,490 A * 11/1962 Arones ..... A47L 11/30 15/359
3,197,798 A * 8/1965 Brown ..... A47L 11/00 15/320
3,204,280 A * 9/1965 Campbell ..... A47L 11/161 15/314
3,345,671 A * 10/1967 Wilson ..... A47L 11/00 15/320
3,550,181 A * 12/1970 Burgoon ..... A47L 11/305 15/320

(Continued)

FOREIGN PATENT DOCUMENTS

CA 2394424 A1 * 9/2003 ..... A47L 11/12

*Primary Examiner* — Joseph J Hail
*Assistant Examiner* — Arman Milanian
(74) *Attorney, Agent, or Firm* — Harness, Dickey & Pierce, P.L.C.

(57) ABSTRACT

A floor cleaning machine having a movable adjustment element, a suction foot, a cleaning head and a drive. The adjustment element is coupled to the cleaning head, the suction foot and the drive. The drive is configured to move the adjustment element between a first position, in which the cleaning head and suction foot are raised, a second position, in which the cleaning head is raised and the suction foot is lowered, and a third position in which the cleaning head and suction foot are lowered.

19 Claims, 6 Drawing Sheets

(56) References Cited

U.S. PATENT DOCUMENTS 3,559,230 A * 2/1971 Ole ..... A47L 11/20 15/302
3,663,985 A * 5/1972 Burgoon ..... A47L 11/30 15/320
3,678,533 A * 7/1972 Cravits ..... A47L 7/0009 15/302
3,824,645 A * 7/1974 Krier ..... A47L 11/30 15/340.3
3,938,212 A * 2/1976 Krier ..... A47L 11/30 15/340.4
4,041,567 A * 8/1977 Burgoon ..... A47L 11/302 15/320
4,363,152 A 12/1982 Karpanty
4,380,844 A * 4/1983 Waldhauser ..... A47L 11/30 15/320
4,805,258 A 2/1989 Sitarski et al.
5,048,141 A * 9/1991 Huppi ..... A47L 11/283 15/49.1
5,279,672 A * 1/1994 Betker ..... A47L 11/305 134/18
5,454,138 A * 10/1995 Mondigo ..... A47L 11/305 15/320
5,742,975 A * 4/1998 Knowlton ..... A47L 11/305 15/320
6,131,240 A * 10/2000 Shark ..... A47L 5/34 15/320
6,295,682 B1 * 10/2001 Klucznik ..... A47L 11/03 15/320
7,640,622 B2 * 1/2010 Vankouwenberg ... A47L 11/201 15/320
7,958,595 B2 * 6/2011 Goff ..... A47L 11/302 15/320

* cited by examiner

FLOOR CLEANING MACHINE

CROSS-REFERENCE TO RELATED APPLICATIONS

This application claims the benefit and priority of European Patent Application No. 14171957.5, filed Jun. 11, 2014. The entire disclosure of the above application is incorporated herein by reference.

FIELD

The present disclosure relates to a floor cleaning machine.

BACKGROUND

This section provides background information related to the present disclosure which is not necessarily prior art.

Floor cleaning machines having a machine frame and a chassis for moving the floor cleaning machine are used to clean large floor areas, for example in public buildings or supermarkets. To this end, the machines are operated in such a manner that, as said machine travels over a floor area of this kind that is to be cleaned, dirt that is located on the floor is initially loosened with the aid of the cleaning head and the brushes provided thereon, which are preferably driven, using fluid that is applied to the floor area by the cleaning head. The contaminated fluid is then suctioned back up with the aid of the suction foot. As such, both the cleaning head and the suction foot are mounted on the machine frame of the floor cleaning machine in a height-adjustable manner, in order to make it possible that both units need not necessarily be in contact with the floor area.

During the operation of a floor cleaning machine of this kind, the following modes of operation or, respectively, combinations of settings for the position of the cleaning head and the suction foot are essentially required. First, it must be possible for both the cleaning head and the suction foot to be lifted and not in contact or, respectively, engaged with the floor area, which is necessary in order that the floor cleaning machine can move freely. A second mode of operation is then needed for the pure suction operation, in which only the suction foot is lowered into a contact position on the floor area, in order that fluid that is still located on the floor area can be suctioned up, however, during which the cleaning head is not on contact with the floor area.

Finally, a third mode of operation must be made possible, in which both the cleaning head and the suction foot are in an engagement or, respectively, contact position with the floor area, so that on the one hand, the floor area is cleaned by means of the cleaning head, and on the other hand, the contaminated water is suctioned up from the floor by means of the suction foot.

In this way, in the case of a floor cleaning machine of this kind, lifting devices must be present both for the suction foot and for the cleaning head, and these lifting devices typically require separate drives, which is associated with considerable costs and a need for installation space.

We have found that there is a need in the art for a floor cleaning machine having a relatively simpler mechanism for adjusting the respective positions of the cleaning head and the suction foot.

SUMMARY

This section provides a general summary of the disclosure, and is not a comprehensive disclosure of its full scope or all of its features.

In one form, the present teachings provide a floor cleaning machine having a machine frame, having a chassis mounted on the machine frame for moving the floor cleaning machine over a floor area that is to be cleaned, having a cleaning head, which is secured to the machine frame in a height-adjustable manner in such a way that said cleaning head can be lowered into an engagement position in which the cleaning head engages with the floor area floor area, and can be raised out of said position, having a suction foot, which is designed to suction fluid from the floor area floor area, and which is secured to the machine frame in a height-adjustable manner in such a way that said suction foot can be lowered into a contact position in which the suction foot rests on the floor area, and can be raised out of said position, having a movable adjustment element, which is coupled to the cleaning head and to the suction foot, and having a drive, which serves to move the adjustment element between a first, a second and a third position, wherein, when the adjustment element is in the first position, the cleaning head is raised out of the engagement position and the suction foot is raised out of the contact position, wherein, when the adjustment element is in the second position, the cleaning head is raised out of the engagement position and the suction foot is lowered into contact position, and wherein, when the adjustment element is in the third position, the cleaning head is lowered into the engagement position and the suction foot is lowered into the contact position.

The floor cleaning machine can have a single adjustment element, which can be moved by means of a drive, and which is mechanically coupled both to the cleaning head, and to the suction foot in such a way that they can be lowered or raised by the movement of said adjustment element. As such, the adjustment element and the coupling to the cleaning head and the suction foot are designed in such a way that the following adjustments of the cleaning head and the suction foot are implemented in the at least three positions between which the adjustment element can be moved.

In a first position, both the cleaning head and the suction foot are lifted off of the floor area and removed therefrom, so that the cleaning head is not in the engagement position, nor is the suction foot in the contact position with the floor area. In the case of this first position of the adjustment element, the floor cleaning machine can be easily moved over the floor area without said floor area being cleaned thereby.

In the second position of the adjustment element, the suction foot is lowered to the floor area to such a degree that said suction foot is in the contact position, while the cleaning head is lifted and is not in the engagement position with the floor area. In the case of this position of the adjustment element, the floor cleaning machine can travel across the floor area and in so doing, can take up fluid therefrom by means of the suction foot, while the cleaning head is not in contact with the floor area.

Finally, the adjustment element can assume a third position, in which, due to the coupling to the suction foot and the cleaning head, both the suction foot and the cleaning head are lowered and assume the contact position or, respectively, the engagement position. In this third position, on the one hand, the floor area is cleaned with the aid of the cleaning head, and on the other hand, the contaminated fluid is simultaneously suctioned up with the aid of the suction foot.

In this way, it possible to lower and raise both the cleaning head and the suction foot through a simple movement of a single adjustment element and with the aid of a single drive, and in so doing, to implement at least the three essentially necessary combinations of positions of the cleaning head and of the suction foot. In this way, it is no longer necessary to provide separate drives for the height adjustment of the cleaning head and the suction foot.

Hydraulic and/or pneumatic drives, such as hydraulic or pneumatic cylinders, can be used as drives for moving the adjustment element. Other mechanical drives, which have electric motors and threaded spindles associated therewith, may also be used, however. In addition, the drives that may be used are not limited to such drives that can generate a linear movement. Rather, such drives may also be used, the output element of which carries out a circular motion, so that the adjustment element then also carries out a movement along at least a part of a circular path.

Optionally, the adjustment element is movable into a fourth position, wherein, when the adjustment element is in this fourth position, the cleaning head is lowered into the engagement position with the floor area, and the suction foot is raised out of the contact position. This fourth position may be desirable when the floor area is to be pre-cleaned in such a way that solely the fluid is to be applied to the floor area and the floor area is to be cleaned by brushes of the cleaning head, which may be driven, if applicable, however initially, the water is to remain on the floor area.

The suction foot and the adjustment element can be coupled with one another in such a way that an elastic element is disposed in the connection between the suction foot and the adjustment element. When the adjustment element is in the first and, if applicable, the fourth position, in which the suction foot is raised and is suspended above the floor area, it frequently occurs that a user exerts a load on the suction foot in the direction of the floor area, for example by means of his body weight. If no elastic element were present between the adjustment element and the suction foot, this load would result in the suction foot of the adjustment element possibly being broken off. If an elastic element is provided, however, said element absorbs the load via an elastic deformation.

It is conceivable that the adjustment element carries out a movement along at least part of a circular path, along which path the respective positions can be assumed. It is also conceivable that the adjustment element carries out a linear movement, since the drive can then be implemented by an electromechanical linear drive, for example.

The suction foot can have a retainer that is pivotably secured to the machine frame, so that the suction foot can be raised out of the contact position with the floor area and lowered into said position by pivoting the retainer, wherein in addition, the retainer has a lever arm, the free end of which is connected to the adjustment element.

The adjustment element itself can carry out a linear movement, such that the suction foot is then raised or lowered due to the fact that the adjustment element is connected to a free end of the lever arm. When this connection between the free end of the lever arm and the adjustment element has a spring element, which absorbs loads through elastic deformation loads arising when the suction foot is lifted and removed from the floor area.

Alternatively, it is also possible for the suction foot to have a retainer, which is pivotably secured to the machine frame, so that the suction foot can be raised out of the contact position and lowered into said position by pivoting the retainer. A lever arm can be provided on the retainer, and in addition, a pivotable coupling element can be provided, which is connected to the free end of the lever arm. The coupling element, in turn, has a first guide track, which engages with the adjustment element, so that this adjustment element can be moved therein. By moving the adjustment element in the first guide track, a pivot position of the coupling element can be modified, which, in turn, results in the retainer also being pivoted between the lowered contact position and a raised position as a result of the pivoting movement.

A design of this kind provides a simple option of implementing the linear movement of the adjustment element in a pivoting movement of the retainer. A spring or another elastic connecting element can be provided between the pivotable coupling element and the lever arm of the retainer, which can absorb unforeseen loads that are exerted thereon in the event that the suction foot is raised.

The cleaning head can have a connection plate, in which a second guide track is formed, with which the adjustment element engages, and in which said adjustment element can be moved, so that a position of the connection plate relative to the machine frame is changed through the movement of the adjustment element along the second guide track. The second guide track in the connection plate has a course such that the straight, linear movement of the adjustment element leads to a vertical movement of the connection plate perpendicular to the plane of the floor area. As a result of the course of the second guide track, in the case of a predefined position of the adjustment element along the linear course thereof, it is possible for the cleaning head to easily assume the desired vertical position, for example the engagement position or a raised position.

When the cleaning head is installed by means of a retainer, which is pivotably secured to the machine frame, wherein the connection plate is mounted on the retainer, so that when the adjustment element is moved, the retainer is pivoted, and can be lowered into the engagement position in which the cleaning head engages with the floor area, and can be raised out of said position. In this way, it is possible to easily implement the vertical movement of the cleaning head without requiring a complicated guide. It is only necessary to provide the pivotable support arm.

Alternatively, the cleaning head may also be connected to the adjustment element via a cable element. As such, on the one hand, it is possible for the cleaning head, in turn, to be mounted, for example to the machine frame, via a pivotable retainer. Alternatively, however, a linear guidance of the cleaning head is also conceivable.

When the adjustment element carries out a linear movement, said element can be mounted on a free end of a piston rod of an electromechanical linear drive. With a linear drive of this kind, on the one hand, it is possible to reliably assume the desired positions, and on the other hand, the necessary forces can also be applied in a simple manner.

The cleaning head can include brushes, which engage with the floor area when the cleaning head is in the lowered position, wherein the brushes may be driven.

The suction foot can define a suction area that can be delimited by a sealing strip and a slotted strip, which are provided in order to come into contact with the floor area, wherein the suction area is connected to a negative pressure source, which is provided in the floor cleaning machine.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
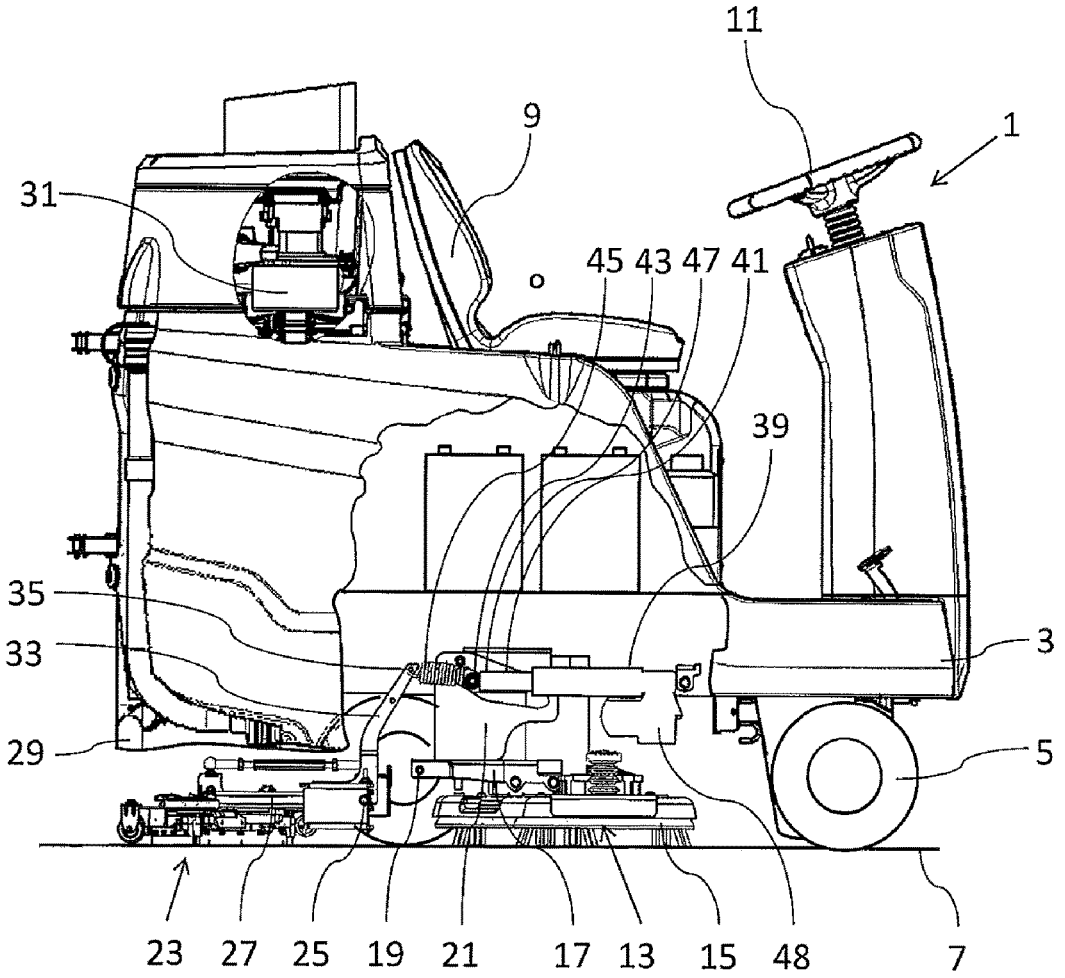
FIG. 1 is a cross-sectional view of a first exemplary embodiment of a floor cleaning machine constructed in accordance with the teachings of the present disclosure.

FIGS. 1 through 5 depict a first exemplary embodiment of a floor cleaning machine according to the invention. The floor cleaning machine 1 has a machine frame 3, on which a chassis having three wheels 5 is provided, which makes it possible to move the floor cleaning machine 1 over a floor area 7 that is to be cleaned. A seat 9 as well as a steering wheel 11 are provided on the machine frame 3, which steering wheel is coupled to the chassis in a manner that is known per se, so that the user, who is sitting on the driver's seat 9, can steer the floor cleaning machine 1 over the floor area 7 that is to be cleaned.

In this way, the exemplary embodiment that is shown here is a ride-on machine. The invention is not limited to ride-on machines, however, but can also be used in the case of floor cleaning machines, which are designed in such a way that a user can guide said machine while on foot.

In addition, the floor cleaning machine 1 has a cleaning head 13, which is provided with driven brushes 15 and is connected to a cleaning fluid container, which is installed in the floor cleaning machine 1. The cleaning head 13 is provided with a retainer 17, which is pivotably hinged to the machine frame 3, on which retainer the cleaning brushes 15 are mounted. The retainer 17 can be pivoted about a swivel axis 19. In addition, as can be seen in FIGS. 2 through 5, a connection plate 21 is also mounted on the retainer 17, said connection plate extending vertically upward from the retainer 17.

In addition, a suction foot 23 is secured to the machine frame 3, wherein the suction foot 23 has a retainer 27, which can be pivoted about a swivel axis 25. At the retainer 27, the actual suction foot assembly is provided with a sealing strip 28, which extends perpendicular to the floor area 7, and with a slotted strip 28', which extends parallel thereto, wherein the slotted strip 28' is disposed in front of the sealing strip 28 as viewed in the direction of travel. A suction area is formed between the sealing strip 28 and the slotted strip 28', which suction area is connected to a negative pressure source in the floor cleaning machine 1 via a suction line 29, which negative pressure source is designed as a blower 31. A lever arm 33 is firmly mounted on the retainer 27 at a free end 35 of said lever arm.

Moreover, as is evident in FIGS. 1 through 5, a drive, which is designed as an electromechanical linear drive 39, is secured to the machine frame 3, the piston rod 41 of which drive can be moved in a linear manner in a direction that extends horizontal and in parallel to the floor area 7. Linear drives of this kind have long been known in the prior art. An adjustment element 43 is provided at the free end of the piston rod 41, wherein the adjustment element 43 is guided in a linear manner in a guide 44, which is firmly mounted on the machine frame 3. In this way, the adjustment element 43 in this exemplary embodiment carries out a purely linear movement.

On the one hand, the adjustment element 43 is coupled to the free end 35 of the lever arm 33 via an elastic element in the form of a tension spring 45. On the other hand, a guide track 47 is formed in the connection plate 21, and a pin provided on the adjustment element 43 engages in the guide track 47, wherein, due to the course of the guide track 47, a linear movement of the piston rod 41 and therefore of the adjustment element 43 results in a raising and lowering motion of the connection plate 21, and therefore in a pivoting movement of the retainer 17. As a result, due to the linear movement of the piston rod 41 or, respectively, of the adjustment element 43, the cleaning head 13 is raised or lowered, as is explained in greater detail below.

In this case, the guide track 47 in the connection plate 21 has a first section 47', which is oriented towards the drive end 48 of the linear drive 39 that is located at a distance from the piston rod 41, and a second section 47", which extends at an angle from the first section 47', which second section starts at the end of the first section 47' that is oriented away from the drive end 48.

Due to the fact that the piston rod 41 of the linear drive 39 can be moved in a linear manner and guided in the guide 44, the adjustment element 43 can be moved along a linear course and in so doing, assume the positions described below.

Figure 2:
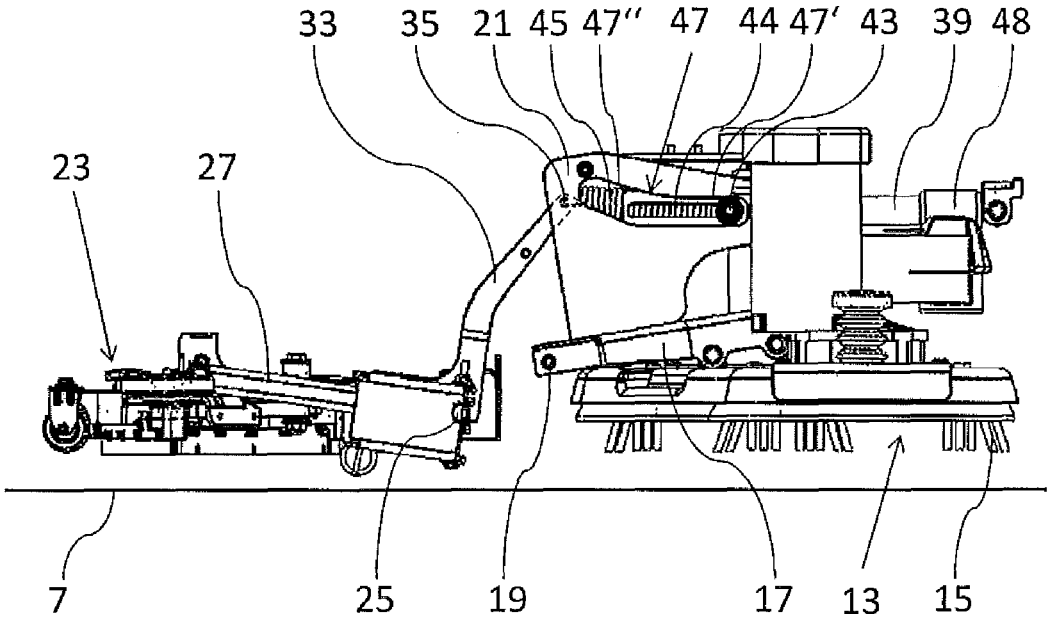
FIG. 2 is a side elevation view that depicts the configuration of the cleaning head and the suction foot of the exemplary floor cleaning machine of FIG. 1, having an adjustment element in a first position in which a cleaning head and a suction foot are both raised.

In the first position, which is depicted in FIG. 2, the piston rod 41 of the linear drive 39 is located in the retracted position, and the adjustment element 43 is positioned in the connection plate 21 at the end of the first section 47' of the guide track 47 that is located at a distance from the second section 47". As a result, the retainer 17 is pivoted upward, about the swivel axis 19, so that the brushes 15 of the cleaning head are spaced apart from the floor area 7, and the cleaning head 13 is not engaged with the floor area 7. At the same time, as a result of the connection between the free end 35 of the lever arm 33 and the adjustment element 43, said lever arm is pivoted likewise in the direction of the linear drive 39 via the tension spring 45, so that the retainer 27 is also pivoted upward and the suction foot 23 is likewise spaced apart from the floor area.

In this way, in this first position of the adjustment element 43, both the cleaning head 13 and the suction foot 23 are lifted out of the engagement position or, respectively, the contact position, and the floor cleaning machine 1 can be moved over the floor area 7 without the floor being in contact with the cleaning elements. The elastic element, which is designed as a tension spring 45, however, ensures that when a load is applied to the suction foot 23 from above, for example through the body weight of the user, this load is absorbed by the tension spring 45, wherein said spring is elastically deformed, and no damage to the retainer of the suction foot 23 occurs.

Figure 3:
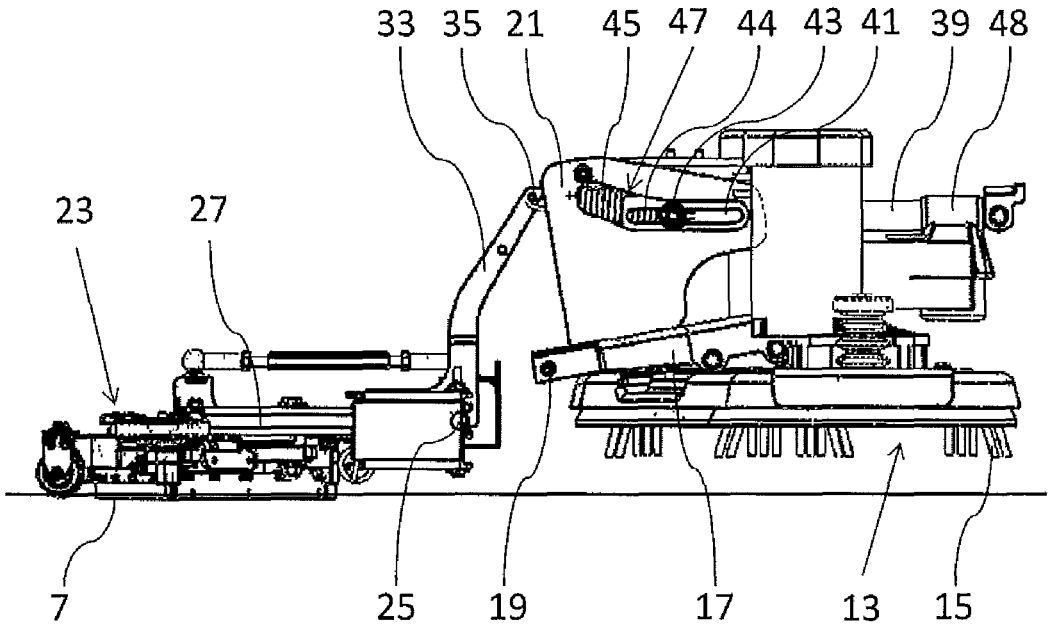
FIG. 3 is a view similar to that of FIG. 2 but depicting the adjustment element in a second position in which the suction head is lowered and the cleaning head is raised.
Figure 4:
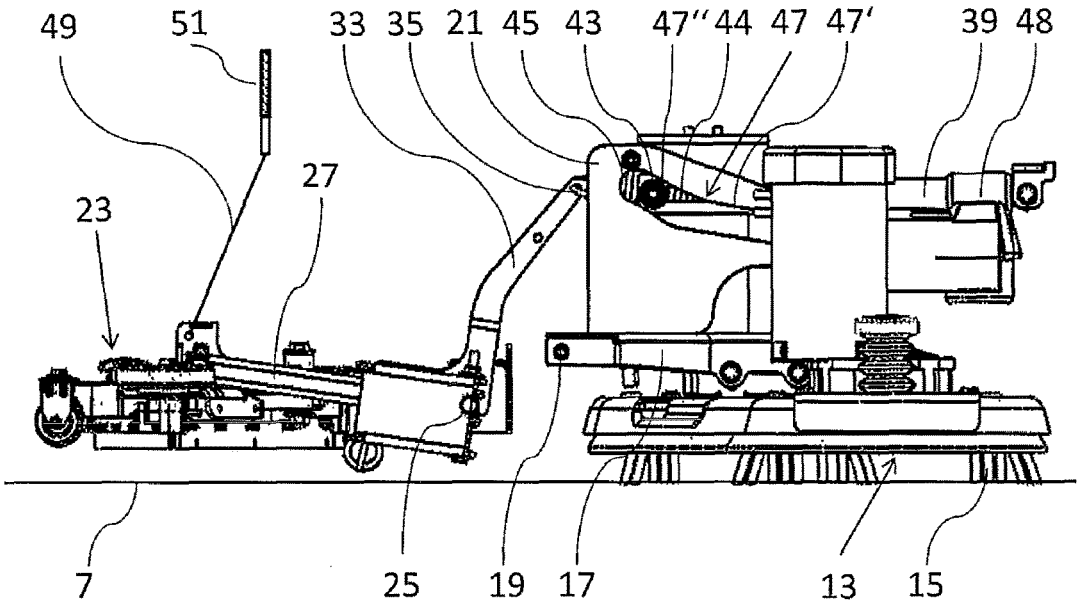
FIG. 4 is a view similar to that of FIG. 2 but depicting the adjustment element in another (i.e., fourth) position in which the cleaning head is lowered and the suction foot is raised.

When the adjustment element 43 is moved into the second position, depicted in FIG. 3, in the guide track 47 adjacent to the transition between the first and the second section 47', 47" through the extension of the piston rod 41, the position of the retainer 17 is scarcely changed or, respectively, is only moved to such a degree that the cleaning head 13 comes to a stop just above the floor area 7. In this way, the cleaning head 13 remains in a raised position. However, the lever arm 33 is pivoted about the swivel axis 25 in a counterclockwise direction, so that the suction foot 23 is lowered and reaches the contact position, in which the sealing strip 28 and the slotted strip 28' come into contact with the floor area 7. In this second position, fluid that is located on the floor area 7 can be suctioned up by means of the suction foot 23 with the aid of the suction line 29 and the blower 31.

Figure 5:
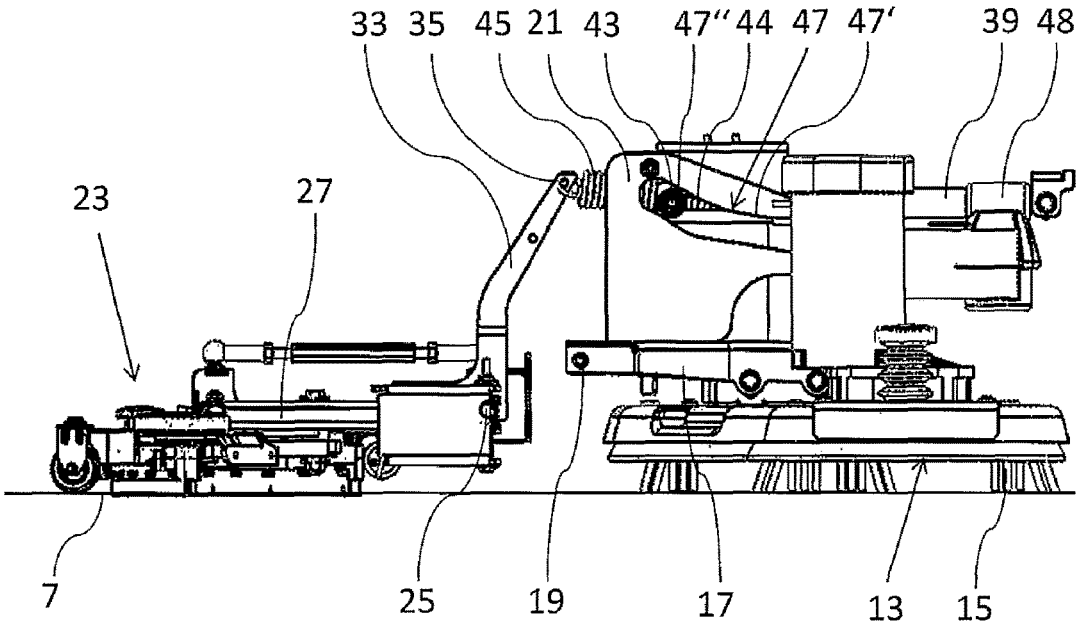
FIG. 5 is a view similar to that of FIG. 2 but depicting the adjustment element in a third position in which the cleaning head and the suction foot are lowered.

In the third position, depicted in FIGS. 1 and 5, the adjustment element 43 is moved to the end of the second section 47" of the guide track 47 through the extension of the piston rod 41, so that the connection plate 21, and thus the retainer 17, carry out a pivoting movement towards the floor area 7. As a result, the cleaning head 13 enters into the engagement position, in which the brushes 15 engage with the floor area 7 and a cleaning movement is created by the rotation of the brushes 15. At the same time, the suction foot 23 remains in the contact position, in which the sealing strip 28 and the slotted strip 28' are in contact with the floor area 7.

In this way, in this third position the cleaning head 13 and the suction foot 23 are lowered into the engagement or, respectively, contact position, and the floor cleaning machine 1 is operated in the normal cleaning mode of operation.

In addition, in the case of this exemplary embodiment it is still possible to suspend the suction foot 23, with the aid of a retainer 49, on a fixed component 51 of the machine frame 3 when the adjustment element 43 is in the third position, which is to say, when the cleaning head 13 and the suction foot 23 have been lowered, so that the suction foot 23 is in the raised position at a distance from the floor area 7. When this is implemented, the floor cleaning machine 1 can move over the floor area 7 with the cleaning head 13 in the engagement position without the suction foot 23 being in contact with said floor area.

Figure 6:
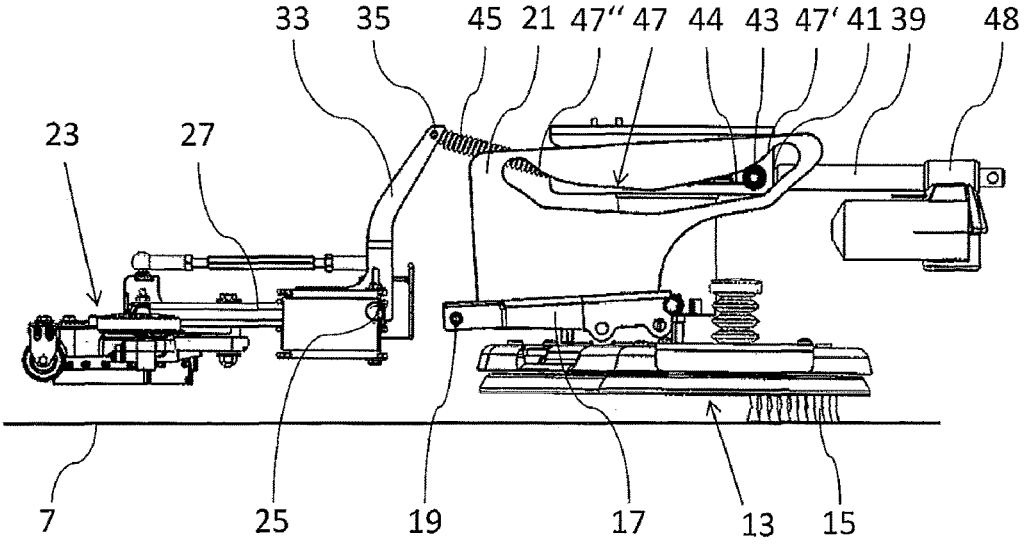
FIG. 6 is a view similar to that of FIG. 2 but depicting another configuration of the cleaning head and the suction foot.

FIG. 6 shows a modification of the above-described exemplary embodiment, in which the guide track 47 in the connection plate 21 has an additional section, which is oriented towards the drive end 48 of the linear drive 39, which section is at a greater distance from the retainer 17 in a vertical direction, so that, when the adjustment element 43 is moved into this section by the complete retraction of the piston rod 41 of the linear drive 39, on the one hand, the cleaning head 13 is lowered into the engagement position with the floor area 7, and on the other hand, the lever arm 33 is pivoted in such a way that the retainer 27 is pivoted upward and the suction foot 23 is not in the contact position with the floor area 7, but rather, is raised. The additional traveling distance that arises as a result of this structure is absorbed by the tension spring 45 through lengthening.

In this way, in the case of this modification, a fourth position for the adjustment element 43 is implemented, in which the cleaning head 13 is lowered into the engagement position and the suction foot 23 is raised out of the contact position. As such, it is not necessary to bring the suction foot 23 into the raised position manually through suspension, with the aid of a retainer, as this was explained in the case of the above-described exemplary embodiment with reference to FIG. 4.

In the above-described exemplary embodiment, the connection plate 21 provided on the retainer 17 of the cleaning head 13 has a guide track 47 having sections 47', 47", which extend at an angle relative to one another, and the movement of the retainer 17 is achieved through this course, while the adjustment element 43 carries out a linear movement relative to the machine frame 3. It is also conceivable for the guide 44 to be provided with a course having sections that are at different angles, and to secure the drive end 48 of the linear drive 39 in a pivotable manner. Then, with a linear guide track in the connection plate 21, it is likewise possible to achieve a pivoting movement of the retainer 17, when the piston rod 41 and the adjustment element 43 are moved. As such, the linear drive is then pivoted relative to the machine frame 3, however.

Figure 7:
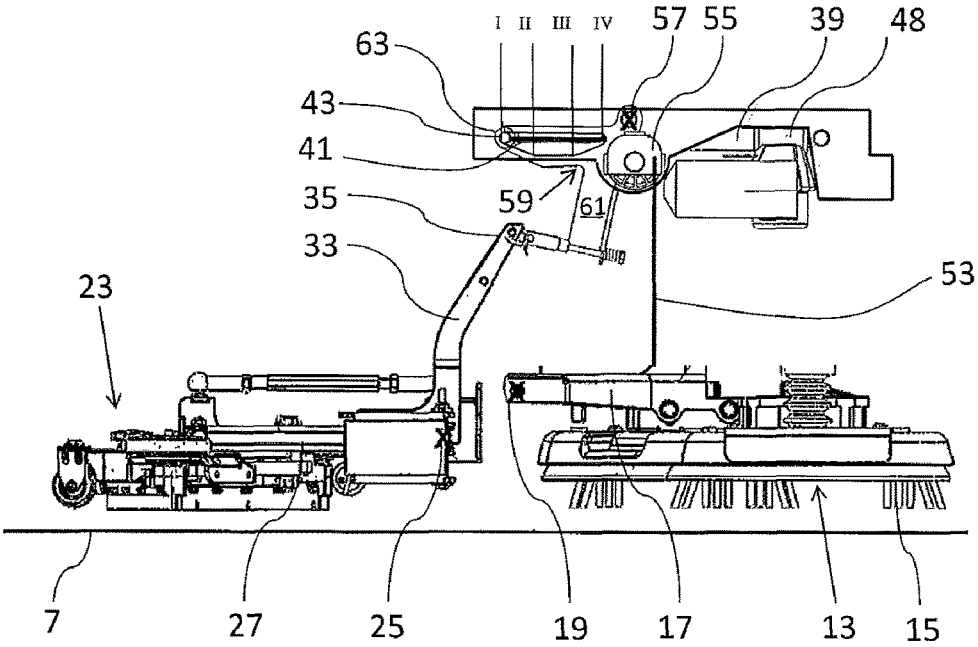
FIG. 7 is a side elevation view of another floor cleaning machine constructed according to the teachings of the present disclosure.
Figure 8:
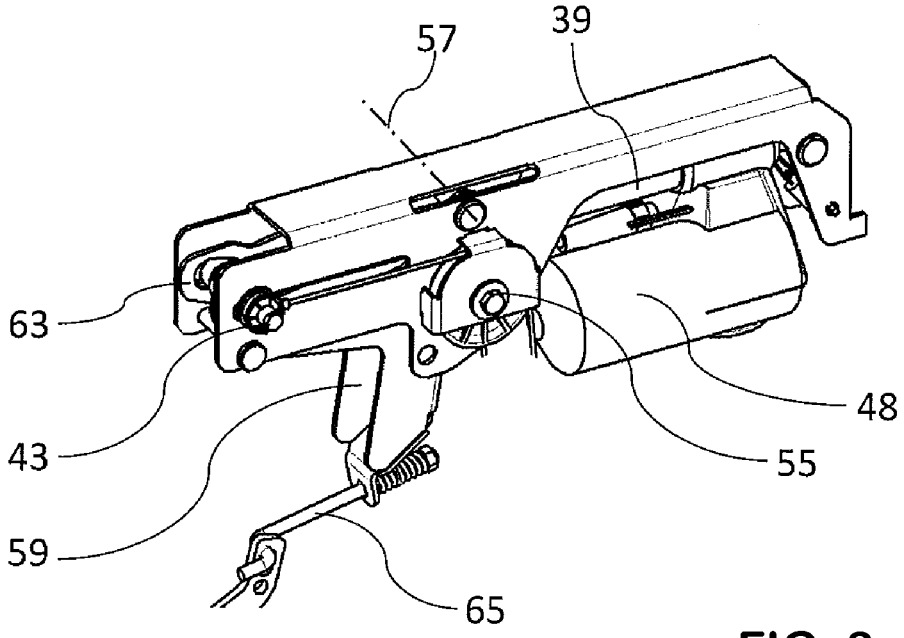
FIG. 8 is a perspective view of a portion of the floor cleaning machine of FIG. 7.
Figure 9:
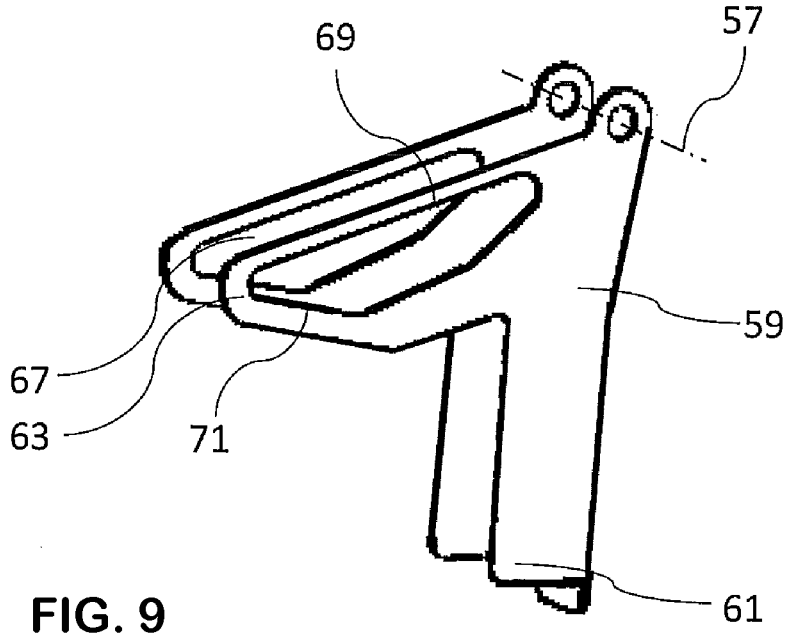
FIG. 9 is a perspective view of a portion of the floor cleaning machine of FIG. 7.
Figure 10:
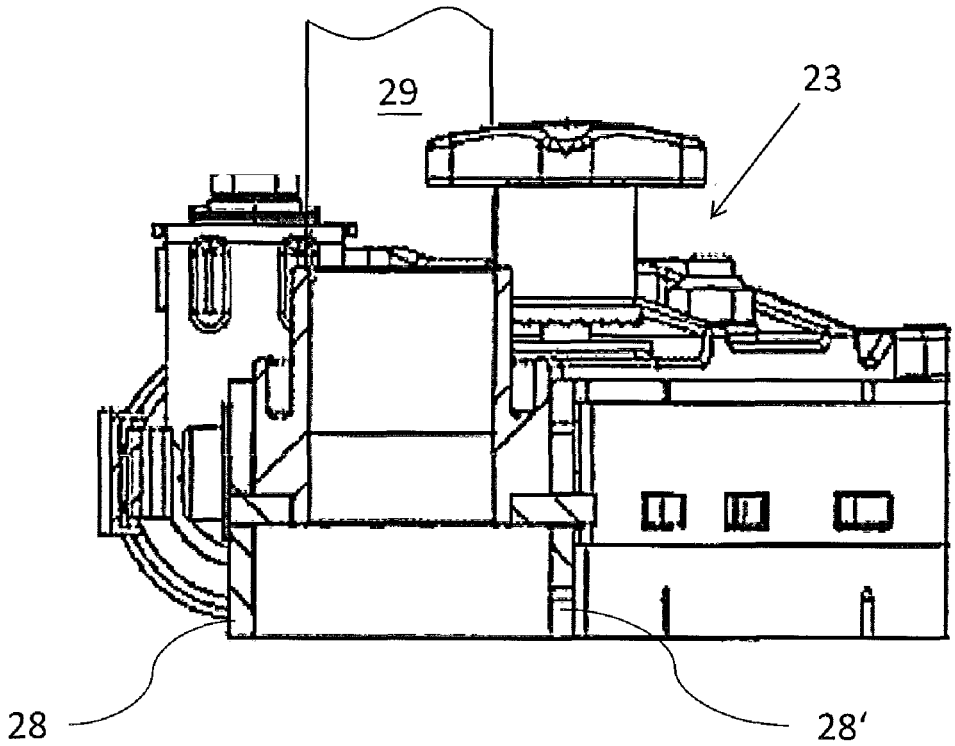
FIG. 10 is a cross-section al view of a portion of the suction foot used in the exemplary floor cleaning machines of FIGS. 1 and 7.

In the case of the alternative exemplary embodiment depicted in FIGS. 7, 8 and 9, the cleaning head 13 is also connected to a pivotable retainer 17, so that, by pivoting the retainer 17, the cleaning head 13 can be lowered into the engagement position or, respectively, can be raised out of said position. Likewise, as in the above-described exemplary embodiments, the suction foot 23 is mounted in a height-adjustable manner via a retainer 27, which is secured to the machine frame 3 such that it can pivot about a swivel axis 25, wherein the retainer 27 has a lever arm 33 having a free end 35. In the case of this exemplary embodiment, on the other hand, a linear drive 39 is provided, wherein the adjustment element 43 is mounted at the free end of the piston rod 41 of said linear drive. As such, the adjustment element 43 also carries out a linear movement here.

A cable element 53 is affixed to the adjustment element 43, which cable element runs over a deflection roller 55 to the retainer 17. In addition, a coupling element 59, which can be pivoted about a swivel axis 57, is secured to the machine frame 3 or, respectively, to an element, which is firmly connected to said machine frame, said coupling element having two arms 61, 63, which extend away from the swivel axis 57.

A spring-loaded connecting element 65 is affixed at one end to the first arm 61, said arm extending downward and away from the swivel axis 57, the other end of which connecting element, in turn, is mounted on the free end 35 of the lever arm 33, so that a connection to an elastic element is formed. In the second arm 63 of the coupling element 59, said arm extending substantially horizontally, on the other hand, a guide track 67 is formed, which has a linear upper edge 69 as well as a lower edge 71, wherein the distance from the lower edge 71 to the upper edge 69 varies, said distance being at a maximum in a central section, while the distance is reduced towards the ends of the guide track 67. During the linear movement of the piston rod 41, the adjustment element 43 is moved along the guide track 67, wherein, due to the torque which is exerted by the suction foot 23 mounted on the retainer 27, the lower edge 71 of the guide track 67 always rests on the adjustment element 43. Thus, when the adjustment element 43 is moved in a linear manner along the guide track 67, the pivot position of the coupling element 59 is changed and thus, the pivot position of the lever arm 33 is likewise changed.

When the adjustment element 43 is in the position I depicted in FIG. 7, wherein the piston rod 41 is completely extended, the coupling element 59 is in a pivot position, in which the first arm 61 is pivoted to the linear drive 39, so that the lever arm 33 is also pivoted in this direction, and the retainer 27, together with the suction foot 23, are raised out of the contact position. In addition, the cleaning head 13 is likewise raised, since the cable element 53 is retracted about the deflection roller 55.

When the adjustment element 43 is now moved along the guide track 67 in the section, where the lower edge 71 is spaced further apart from the upper edge 69 by retracting the piston rod 41, the coupling element 59 is pivoted about the swivel axis 57 in a clockwise direction, so that the suction foot 23 is lowered. At the same time, the cleaning head 13 is also lowered by the cable element 53. The further the piston rod 41 is retracted, the further the cleaning head 13 is lowered. When the adjustment element 43 is finally moved all the way to the end of the guide track 67 pointing to the linear drive 39 or the swivel axis 57, respectively, the coupling element 59, in turn, is pivoted back to the linear drive 39 and the suction foot 23 is raised, while the cleaning head 13 remains in the lowered engagement position.

In this way, in this exemplary embodiment as well, the following four positions I, II, III, IV are implemented in succession by means of the linear movement of the adjustment element 43:

the first position I, in which the piston rod 41 is completely extended and the adjustment element 43 is located at the end of the guide track 67 that is located at a distance from the swivel axis 57, so that the suction foot 23 is raised out of the contact position and the cleaning head 13 is likewise raised out of the engagement position, the second position II, in which the adjustment element 43 is moved to the swivel axis 57, so that the suction foot 23 is lowered into the contact position, while the cleaning head 13 is raised out of the engagement position, the third position III, in which both the suction foot 23 and the cleaning head 13 are lowered into the contact position or, respectively, the engagement position, and the fourth position IV, in which the adjustment element 43 is moved to the end of the guide track 67 that is oriented towards the swivel axis 57, so that the suction foot 23 is raised out of the contact position, however, the cleaning head 13 is lowered into the engagement position.

In the case of each of the above-described exemplary embodiments, only one drive, in the form of the linear drive 39, must be used in order to move the suction foot 23 and the cleaning head 13, wherein, in so doing, the combinations of adjustments of the cleaning head 13 and the suction foot 23 needed in order to operate the floor cleaning machine 1 can be implemented. As such, it should be noted that in the above-described exemplary embodiments, the adjustment element 43 carries out a straight, linear movement, and both the cleaning head 13 and the suction foot 23 are pivotably connected to the machine frame 3. It is also conceivable that the adjustment element carries out a circular movement, in order that said element can be moved back and forth between the individual positions. In addition, it is also possible for the cleaning head and the suction foot be secured to the machine frame such that they can be displaced in a linear manner.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A floor cleaning machine comprising:

a machine frame, a chassis mounted on the machine frame, the chassis being adapted for moving the floor cleaning machine over a floor area that is to be cleaned, a cleaning head that is height-adjustably secured to the machine frame for movement between an engagement position, in which the cleaning head engages with the floor area, and a raised head position, a suction foot, which is adapted to suction fluid from the floor area, the suction foot being height-adjustably secured to the machine frame for movement between a contact position, in which the suction foot rests on the floor area, and a raised foot position, a movable adjustment element, which is coupled to the cleaning head and to the suction foot, and a drive, which is selectively operable to move the adjustment element between a first position, a second position and a third position, wherein, when the adjustment element is in the first position, the cleaning head is raised out of the engagement position and the suction foot is raised out of the contact position, wherein, when the adjustment element is in the second position, the cleaning head is raised out of the engagement position and the suction foot is lowered into the contact position and wherein, when the adjustment element is in the third position, the cleaning head is lowered into the engagement position, and the suction foot is lowered into the contact position.

2. The floor cleaning machine according to claim 1, wherein the adjustment element is selectively movable into a fourth position, and wherein when the adjustment element is in the fourth position, the cleaning head is lowered into the engagement position, and the suction foot is raised out of the contact position.

3. The floor cleaning machine according to claim 1, wherein the suction foot and the adjustment element are coupled with one another in such a way that an elastic element is disposed between the suction foot and the adjustment element.

4. The floor cleaning machine according to claim 1, wherein the adjustment element is movable in a linear manner.

5. The floor cleaning machine according to claim 4, wherein the suction foot has a retainer, which is pivotably secured to the machine frame, so that the suction foot can be raised out of the contact position and lowered into the contact position by pivoting the retainer, and wherein the retainer has a lever arm with a free end that is connected to the adjustment element.

6. The floor cleaning machine according to claim 5, wherein a spring element is disposed between the free end of the lever arm and the adjustment element.

7. The floor cleaning machine according to claim 4, wherein the suction foot has a retainer, which is pivotably secured to the machine frame, so that the suction foot can be raised out of the contact position and lowered into the contact position by pivoting the retainer, wherein the retainer has a lever arm, wherein a pivotably mounted coupling element is connected to a free end of the lever arm, and wherein the coupling element has a first guide track, with which the adjustment element engages and in which said adjustment element can be moved, so that a pivot position of the coupling element is changed when the adjustment element is moved along the first guide track.

8. The floor cleaning machine according to claim 7, wherein an elastic connecting element is provided between the free end of the lever arm and the coupling element.

9. The floor cleaning machine according to claim 4, wherein the cleaning head has a connection plate, in which a second guide track is formed, with which the adjustment element engages and in which said adjustment element can be moved, so that a position of the connection plate relative to the machine frame is changed when the adjustment element is moved along the second guide track.

10. The floor cleaning machine according to claim 9, wherein the cleaning head has a retainer, which is pivotably secured to the machine frame, and wherein the connection plate is affixed to the retainer, so that when the adjustment element is moved, the retainer is pivoted to cause corresponding motion of the cleaning head between the engagement position and the raised head position.

11. The floor cleaning machine according to claim 8, wherein the cleaning head is connected to the adjustment element via a cable element.

12. The floor cleaning machine according to claim 11, wherein the adjustment element is provided at a free end of a piston rod of an electromechanical linear drive.

13. The floor cleaning machine according to claim 12, wherein the cleaning head has brushes that are adapted to engage with the floor area when in the lowered position.

14. The floor cleaning machine according to claim 13, wherein the suction foot has a suction area, which is delimited by a sealing strip and a slotted strip, said sealing and slotted strips being adapted to contact with the floor area when the suction foot is in the contact position, and wherein floor cleaning machine further comprises a negative pressure source that is coupled in fluid connection with the suction area.

15. The floor cleaning machine according to claim 4, wherein the cleaning head has a connection plate, in which a guide track is formed, with which the adjustment element engages and in which said adjustment element can be moved, so that a position of the connection plate relative to the machine frame is changed when the adjustment element is moved along the guide track.

16. The floor cleaning machine according to claim 4, wherein the cleaning head is connected to the adjustment element via a cable element.

17. The floor cleaning machine according to claim 4, wherein the adjustment element is provided at a free end of a piston rod of an electromechanical linear drive.

18. The floor cleaning machine according to claim 1, wherein the cleaning head has brushes that are adapted to engage with the floor area when in the lowered position.

19. The floor cleaning machine according to claim 1, wherein the suction foot defines a suction area, which is delimited by a sealing strip and a slotted strip, said sealing and slotted strips being adapted to contact with the floor area when the suction foot is in the contact position, and wherein floor cleaning machine further comprises a negative pressure source that is coupled in fluid connection with the suction area.

* * * * *